US008321265B2

(12) United States Patent
Aschenbrenner et al.

(10) Patent No.: US 8,321,265 B2
(45) Date of Patent: Nov. 27, 2012

(54) METHOD FOR COLLECTING TOLLS FOR LOCATION USAGES

(75) Inventors: Roland Aschenbrenner, Vienna (AT); Thomas Aschenbrenner, Vienna (AT); Christian Goldmann, Zistersdorf (AT)

(73) Assignee: Kapsch Trafficcom AG, Vienna (AT)

( * ) Notice: Subject to any disclaimer, the term of this patent is extended or adjusted under 35 U.S.C. 154(b) by 1 day.

(21) Appl. No.: 13/089,073

(22) Filed: Apr. 18, 2011

(65) Prior Publication Data

US 2011/0282717 A1 Nov. 17, 2011

(30) Foreign Application Priority Data

May 12, 2010 (EP) ..... 10450084

(51) Int. Cl.
*G07B 15/00* (2011.01)

(52) U.S. Cl. ..... 705/13

(58) Field of Classification Search ..... 705/13, 705/417; 340/928
See application file for complete search history.

(56) References Cited

U.S. PATENT DOCUMENTS

| | | | | |
|---|---|---|---|---|
| 5,864,831 | A * | 1/1999 | Schuessler | 705/417 |
| 5,970,481 | A * | 10/1999 | Westerlage et al. | 705/417 |
| 2004/0119609 | A1* | 6/2004 | Solomon | 340/928 |
| 2005/0278214 | A1* | 12/2005 | Takida | 705/13 |
| 2009/0024458 | A1* | 1/2009 | Palmer | 705/13 |
| 2010/0198665 | A1* | 8/2010 | Daems et al. | 705/13 |
| 2011/0131238 | A1* | 6/2011 | Peeters et al. | 707/769 |

FOREIGN PATENT DOCUMENTS

| | | | |
|---|---|---|---|
| DE | 102 00 497 A1 | | 7/2003 |
| EP | 2320386 | * | 5/2011 |
| EP | 2325806 | * | 5/2011 |
| WO | WO 02/071366 A1 | | 9/2002 |
| WO | WO 02/084612 A1 | | 10/2002 |
| WO | WO 2006/015792 A1 | | 2/2006 |
| WO | WO 2008/000227 A1 | | 1/2008 |
| WO | WO 2009/001303 A1 | | 12/2008 |

OTHER PUBLICATIONS

English Translation—EP2320386 pp. 1-4 of 4.*
English Translation—EP2325806 pp. 1-4 of 4.*
English Translation—WO02084612 pp. 1-8 of 8.*
Extended Search Report for corresponding European Patent Application No. 10 450 084.8, 6pp.

* cited by examiner

*Primary Examiner* — John Hayes
*Assistant Examiner* — Brian Epstein
(74) *Attorney, Agent, or Firm* — Christie, Parker & Hale, LLP.

(57) ABSTRACT

A method for collecting tolls for location usages of an on-board unit, which has a unit identifier in a road toll system and a mobile telecommunications identifier in a mobile telecommunications network. The method includes storing the unit identifier and the mobile telecommunications identifier of the on-board unit in a control centre of the road toll system, sending the position-fix data from the on-board unit, under the mobile telecommunications identifier as sole identification, to a toll calculation server, calculating location-anonymised toll data in the toll calculation server, and sending said toll data under the mobile telecommunications identifier to a control centre of the mobile telecommunications network, charging a user account assigned to the mobile telecommunications identifier in the control centre of the mobile telecommunications network, sending a confirmation to the control centre of the road toll system under the mobile telecommunications identifier, and retrieving the unit identifier associated with the mobile telecommunications identifier and providing the confirmation in the control centre of the road toll system.

7 Claims, 1 Drawing Sheet

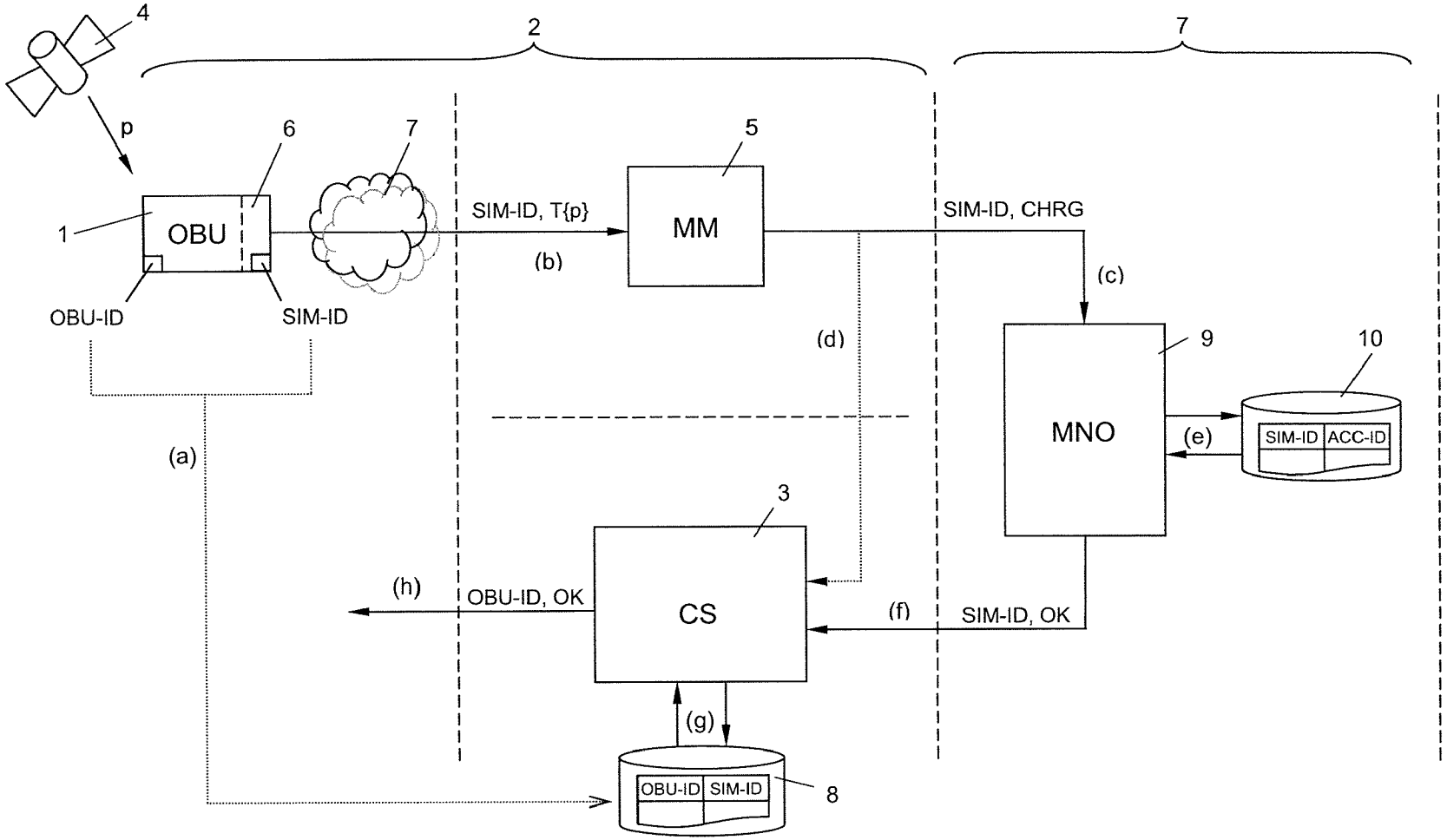
7
10
SIM-ID
ACC-ID
9
(e)
(c)
MNO
SIM-ID, CHRG
SIM-ID, OK
(f)
(d)
8
5
MM
3
CS
(g)
OBU-ID
SIM-ID
2
SIM-ID, T{p}
(b)
OBU-ID, OK
(h)
7
6
SIM-ID
OBU
(a)
4
p
1
OBU-ID

METHOD FOR COLLECTING TOLLS FOR LOCATION USAGES

CROSS-REFERENCE TO RELATED APPLICATION(S)

This application claims priority to European Patent Application No. 10 450 084.8, filed on May 12, 2010, the contents of which are hereby expressly incorporated by reference.

FIELD OF THE INVENTION

The present invention relates to a method for collecting tolls for location usages of a position-fixing on-board unit, which has a unit identifier for identification in a road toll system and a mobile telecommunications unit having a separate mobile telecommunications identifier for identification in a mobile telecommunications network.

BACKGROUND

On-board units for road toll systems are also known as OBUs. OBUs that can determine and fix their position themselves, for example, using a satellite navigation receiver, are currently available in two different embodiments. So-called "thick client" OBUs use stored toll maps as the basis for calculating location-anonymised toll data from their position-fix data, and send this toll data, for example, via a mobile telecommunications network to a control centre of the road toll system, a procedure that requires expensive distribution of the toll maps to the OBUs and a large amount of processing power in the OBUs. In contrast, so-called "thin client" OBUs do not evaluate their position-fix data themselves but send this data "raw" to a control centre, which in turn performs "map matching" to generate toll data therefrom. Thin client OBUs therefore have a substantially simpler and cheaper design, but present a problem from the data-protection viewpoint, because the control centre of the road toll system gains knowledge of the full set of position-fix data ("movement profile") of an OBU.

Therefore it has already been proposed in WO 2008/000227 to send the position-fix data of a thin client OBU under an anonymised sender identifier to a special toll calculation server, which performs the map matching and sends back to the OBU location-anonymised toll data, which the OBU then transmits to the control centre. WO 2009/001303 describes a similar type of solution.

The known data protection solutions have the disadvantage that they cause higher levels of data traffic in the road toll system and/or mobile telecommunications system and require additional data transmissions by the OBU, which also results in a correspondingly higher power consumption of the OBU.

SUMMARY

The present invention improves upon this method by providing data protection or confidentiality for the movement profile of the user in a simpler and cheaper manner than the known solutions. In some embodiments, the present invention is a method for collecting tolls for location usages of a position-fixing on-board unit, a unit identifier for identification in a road toll system and a mobile telecommunications unit having a separate mobile telecommunications identifier for identification in a mobile telecommunication network.

The method includes: storing the unit identifier and the mobile telecommunications identifier of the on-board unit as mutually associated data in a control centre of the road toll system, sending the position-fix data from the on-board unit, using the mobile telecommunications identifier as sole identification of the on-board unit, to a toll calculation server of the road toll system, and calculating location-anonymised toll data from the position-fix data in the toll calculation server, and sending the location-anonymised toll data with the mobile telecommunications identifier to a control centre of the mobile telecommunications network. The method further includes: charging a user account assigned to the mobile telecommunications identifier in the control centre of the mobile telecommunications network according to the received toll data, sending a confirmation that the account has been charged from the control centre of the mobile telecommunications system to the control centre of the road toll system using the mobile telecommunications identifier, and retrieving the unit identifier associated with the mobile telecommunications identifier and providing the confirmation using the retrieved unit identifier in the control centre of the road toll system.

The invention utilizes a mobile telecommunications identifier that exists in the OBU for OBUs supported by the mobile telecommunications network, for example, a SIM card identifier in GSM networks, as identification for the map-matching process in the toll calculation server. The toll calculation server is part of the road toll system and, at this point in time, does not have any information or means of association between the received mobile telecommunications identifier and the individual onboard unit or user, and therefore its location-anonymisation function runs completely anonymously.

On the other hand, the mobile telecommunications identifier can subsequently be used in the control centre of the mobile telecommunications network to deduct a suitable toll charge, because the associated user identity is known in the mobile telecommunications network. On its part, the control centre of the mobile telecommunications network does not receive any information about the movement profile of the user. Nor is it possible to trace the original movement profile of the user when the charging process is confirmed to the road toll system and hence data protection is also guaranteed for the user in the road toll system. The charging information that is assignable to a unit identifier in the road toll system can then be used for enforcement purposes.

BRIEF DESCRIPTION OF THE DRAWINGS

FIG. 1 shows a block diagram of the components involved in a method of the invention and shows the information flow between these components, according to some embodiments of the present invention.

DETAILED DESCRIPTION

In some embodiments, a toll calculation server sends the location-anonymised toll data using the mobile telecommunications identifier additionally to the control centre of the road toll system, where the arriving toll data is compared with the arriving confirmations by means of the mobile telecommunications identifiers. If for toll data of a specific mobile telecommunications identifier, no confirmation having this mobile telecommunications identifier arrives within a time frame, the associated unit identifier is retrieved and output in an alarm message. This can be used to provide an additional checking facility without compromising data protection.

In principle, every identifier that exists within the mobile telecommunications network and that can be assigned to a user (account) in the control centre of the mobile telecommunications network can be used as the mobile telecommunications identifier, for example a telephone number, IMSI or IMEI of a GSM network or the like. Preferably, the mobile telecommunications identifier is obtained from a SIM card of the mobile telecommunications unit, whereby the user can personalise the OBU by using his personal SIM card.

The method of the invention is suitable for all types of on-board units that have a mobile telecommunications unit, whatever means they use to determine their position, whether by local radio beacons of a DSRC road toll system, by wireless location finding or cell identification in a mobile telecommunications network or the like. The on-board unit preferably generates its position-fix data in a manner known per se by means of a satellite navigation receiver, for example, a GPS receiver.

FIG. 1 shows an on-board unit (OBU) 1, which travels on board a vehicle (not shown) within a road toll system 2 having a control centre 3, according to some embodiments of the present invention. The on-board unit 1 has a unique unit identifier OBU-ID, from which the on-board unit can be identified in the road toll system 2, in order to be able to collect tolls for time-based and/or position-based location usages of the on-board unit 1, such as travelling along a toll road, entering an area subject to an entrance fee, staying in a parking space liable to charges etc. To do this, the on-board unit 1 continuously records or "fixes" its position p, for example using a satellite navigation receiver within a satellite navigation system 4, in order to generate therefrom position-fix data T{p}, also referred to as "position fix tracks", as is known in the art.

The position-fix data T{p} is sent from the on-board unit 1 to a toll calculation server 5. The toll calculation server 5 is a map-matching proxy of a type known per se, which assigns the position-fix data T{p} to locations, road sections or areas that are subject to toll charges from a toll map database, and determines associated toll data CHRG from the toll map database. The toll calculation server 5 calculates in this way "location-anonymised" toll data CHRG, from which it is no longer possible to trace the individual items of position-fix data T{p}, for example a single charge amount for the position-fix data T{p}.

In some embodiments, the following method is employed in order to guarantee anonymity for the on-board unit 1. The method is based on on-board units 1 that are equipped in a manner known per se with a mobile telecommunications unit 6, via which they can communicate with the road toll system 2, in particular with the toll calculation server 5. The mobile telecommunications unit 6 is, for example, a conventional GSM module for a GSM mobile telecommunications network 7. The mobile telecommunications unit 6 is equipped for this purpose with a unique mobile telecommunications identifier SIM-ID for the mobile telecommunications network 7, for example (in a GSM network) with an IMSI, TIMSI, IMEI etc.

When the on-board unit 1 is issued to the user, initially a) the on-board unit identifier OBU-ID and the mobile telecommunications identifier SIM-ID of the on-board unit 1 are stored or registered in the control centre 3 of the road toll system 2, more precisely in a database 8 of the control centre 3 of the road toll system, in order to associate the identifiers with each other.

On sending the position-fix data T{p} from the on-board unit 1 to the toll calculation server 5 (step b), the mobile telecommunications identifier SIM-ID is now solely used as identification of the on-board unit 1 to the toll calculation server 5. For the toll calculation server 5, which is part of the road toll system 2 and which has no knowledge of the mobile telecommunications identifiers SIM-ID in the mobile telecommunications system 7, a received mobile telecommunications identifier SIM-ID is effectively "anonymous". The calculations on the position-fix data T{p} to produce the location-anonymised toll data CHRG are therefore carried out under this anonymous mobile telecommunications identifier SIM-ID. The toll data CHRG is then sent under the mobile telecommunications identifier SIM-ID to a control centre 9 of the mobile telecommunications network 7 (step c). Optionally, the toll data CHRG is also sent under the mobile telecommunications identifier SIM-ID to the control centre 3 of the road toll system for comparison purposes (step d).

In the control centre 9 of the mobile telecommunications network, a user account ACC-ID, which is assigned to the mobile telecommunications identifier SIM-ID and is located in a user account database 10 can now be charged according to, or using, the received toll data CHRG, for example, with a fee amount, clearing note etc. (step e). Then, the control centre 9 of the mobile telecommunications network sends a confirmation OK that the account has been charged e) under the mobile telecommunications identifier SIM-ID to the control centre 3 of the road toll system (step f). In the control centre 3 of the road toll system, the charging confirmation OK received under the mobile telecommunications identifier SIM-ID is re-associated with the unit identifier OBU-ID using the association database 8, and can be provided under the unit identifier OBU-ID, for instance for enforcement purposes (step h).

When the control centre 3 of the road toll system receives in step d) information about the toll data CHRG sent from the charging server 5 to the control centre 9 of the mobile telecommunications network, the toll data CHRG arriving in the control centre 3 of the road toll system in step d) can be compared with the charging confirmations OK arriving in step f) and, in the event that no confirmation OK is received for toll data CHRG of a particular mobile telecommunications identifier SIM-ID within a preset time frame, the associated unit identifier OBU-ID is retrieved from the database 8 and for example, output as part of an alarm message.

It will be recognized by those skilled in the art that various modifications may be made to the illustrated and other embodiments of the invention described above, without departing from the broad inventive scope thereof. It will be understood therefore that the invention is not limited to the particular embodiments or arrangements disclosed, but is rather intended to cover any changes, adaptations or modifications which are within the scope and spirit of the invention as defined by the appended claims.

What is claimed is:

1. A method for collecting tolls for location usages of a position-fixing on-board unit, which has a unit identifier for identification in a road toll system and a mobile telecommunications unit having a separate mobile telecommunications identifier for identification in a mobile telecommunications network, the method comprising:

storing the unit identifier and the mobile telecommunications identifier of the on-board unit as mutually associated data in a control centre of the road toll system;

sending position-fix data from the on-board unit, using the mobile telecommunications identifier as sole identification of the on-board unit, to a toll calculation server of the road toll system;

calculating location-anonymised toll data from the position-fix data in the toll calculation server;

sending the location-anonymised toll data with the mobile telecommunications identifier from the toll calculation server to a control centre of the mobile telecommunications network;

charging a user account assigned to the mobile telecommunications identifier in the control centre of the mobile telecommunications network according to the received toll data;

sending a confirmation that the account has been charged from the control centre of the mobile telecommunications system to the control centre of the road toll system using the mobile telecommunications identifier; and retrieving the unit identifier associated with the mobile telecommunications identifier and providing the confirmation using the retrieved unit identifier in the control centre of the road toll system.

2. The method according to claim 1, further comprising:

sending the location-anonymised toll data with the mobile telecommunications identifier from the toll calculation server to the control centre of the road toll system, comparing received toll data with received confirmations using their mobile telecommunications identifiers in the control centre of the road toll system; and when for toll data of a specific mobile telecommunications identifier, no confirmation having said mobile telecommunications identifier arrives within a time frame, retrieving the associated unit identifier and outputting the associated unit identifier in an alarm message.

3. The method according to claim 1, wherein the mobile telecommunications identifier is obtained from a SIM card of the mobile telecommunications unit.

4. The method according to claim 2, wherein the mobile telecommunications identifier is obtained from a SIM card of the mobile telecommunications unit.

5. The method according to claim 1, wherein the on-board unit generates the position-fix data using a satellite navigation receiver.

6. The method according to claim 2, wherein the on-board unit generates the position-fix data using a satellite navigation receiver.

7. The method according to claim 4, wherein the on-board unit generates the position-fix data using a satellite navigation receiver.

* * * * *